US008511522B2

(12) United States Patent
Chan et al.

(10) Patent No.: US 8,511,522 B2
(45) Date of Patent: Aug. 20, 2013

(54) VALVE AND DISPENSER COMPRISING SAME

(75) Inventors: John Geoffrey Chan, Maineville, OH (US); Lawrence Edward O'Brien, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 675 days.

(21) Appl. No.: 12/604,931

(22) Filed: Oct. 23, 2009

(65) Prior Publication Data

US 2010/0133301 A1 Jun. 3, 2010

Related U.S. Application Data

(60) Provisional application No. 61/107,902, filed on Oct. 23, 2008.

(51) Int. Cl.
*B65D 83/00* (2006.01)

(52) U.S. Cl.
USPC ..... 222/563; 222/402.1

(58) Field of Classification Search
USPC ..... 222/402.1, 563, 321.6, 321.1, 321.7, 222/321.9, 383.1, 383.3; 251/359
See application file for complete search history.

(56) References Cited

U.S. PATENT DOCUMENTS

| | | | | |
|---|---|---|---|---|
| 2,207,816 | A * | 7/1940 | Packer | 222/482 |
| 3,406,877 | A * | 10/1968 | Frangos | 222/402.1 |
| 3,685,695 | A * | 8/1972 | Yuhas | 222/129 |
| 3,696,977 | A | 10/1972 | Davenport et al. | |
| 3,764,104 | A | 10/1973 | Kempton | |
| 4,251,032 | A | 2/1981 | Werding | |
| 4,651,899 | A * | 3/1987 | Pauls et al. | 222/130 |
| 4,964,540 | A | 10/1990 | Katz | |
| 5,111,971 | A | 5/1992 | Winer | |
| 5,115,944 | A | 5/1992 | Nikolich | |
| 5,143,260 | A | 9/1992 | Loychuk | |
| 5,143,263 | A | 9/1992 | Newell | |
| 5,183,189 | A * | 2/1993 | Baudin | 222/397 |

(Continued)

FOREIGN PATENT DOCUMENTS

| | | |
|---|---|---|
| DE | 562704 C | 10/1932 |
| DE | 2644780 | 4/1978 |
| JP | 2000/271991 A | 3/1999 |
| WO | WO 2006/101631 A2 | 9/2006 |

OTHER PUBLICATIONS

U.S. Appl. No. 12/604,965, filed Oct. 23, 2009, John Geoffrey Chan, et al.

(Continued)

*Primary Examiner* — Paul R Durand
*Assistant Examiner* — Donnell Long
(74) *Attorney, Agent, or Firm* — Jay A. Krebs

(57) ABSTRACT

A valve having a sleeve comprising a sleeve wall including an inner surface; and a plug positioned within the sleeve, the plug comprising at least one portion that is elastically deformable. The plug forms a blind hole extending into the plug from one end thereof to define a plug side wall, and a flow passage that extends through the plug side wall that is either open or openable. The plug defines a valve closed position in an unstressed state, yet is capable of elastically deforming to define a flow channel between the plug and the sleeve in a valve open position. A dispenser containing such a valve is also provided.

8 Claims, 6 Drawing Sheets

(56) References Cited

U.S. PATENT DOCUMENTS

| | | | | |
|---|---|---|---|---|
| 5,232,126 | A | 8/1993 | Winer | |
| 5,265,765 | A | 11/1993 | Maier | |
| 5,277,015 | A | 1/1994 | Brown et al. | |
| 5,289,818 | A * | 3/1994 | Citterio et al. | 128/200.14 |
| 5,441,174 | A | 8/1995 | Sperry | |
| 5,850,908 | A | 12/1998 | Jasek | |
| 5,895,029 | A | 4/1999 | Lacout | |
| 5,927,551 | A | 7/1999 | Taylor et al. | |
| 6,250,505 | B1 | 6/2001 | Petit | |
| 6,450,216 | B1 * | 9/2002 | Stradella | 141/27 |
| 6,536,631 | B1 | 3/2003 | Nickels et al. | |
| 6,712,095 | B2 * | 3/2004 | Williamson et al. | 137/854 |
| 7,731,065 | B2 * | 6/2010 | Ingram et al. | 222/494 |
| 2007/0000950 | A1 * | 1/2007 | Ingram et al. | 222/320 |
| 2009/0188948 | A1 * | 7/2009 | Stern et al. | 222/402.1 |

OTHER PUBLICATIONS

U.S. Appl. No. 12/605,001, filed Oct. 23, 2009, John Geoffrey Chan, et al.

U.S. Appl. No. 61/327,981, filed Apr. 26, 2010, John Geoffrey Chan, et al.

U.S. Appl. No. 61/327,994, filed Apr. 26, 2010, John Geoffrey Chan, et al.

U.S. Appl. No. 61/328,509, filed Apr. 27, 2010, David Matthew Groh.

PCT International Search Report with Written Opinion in corresponding Int'l appln. PCT/US2009/061757 dated Oct. 23, 2009.

* cited by examiner

VALVE AND DISPENSER COMPRISING SAME

CROSS REFERENCE TO RELATED APPLICATION

This application claims priority under 35 U.S.C. §119(e) to U.S. Provisional Application Ser. No. 61/107,902, filed Oct. 23, 2008 to John Geoffrey Chan et al.

FIELD OF THE INVENTION

The present invention is directed to valves that can be employed in a variety of host devices and used in a number of different applications, including, for example, containers and dispensers associated with consumer products. The present invention is also directed to dispensers employing the valves provided herein.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

SUMMARY OF THE INVENTION

Figure 2:
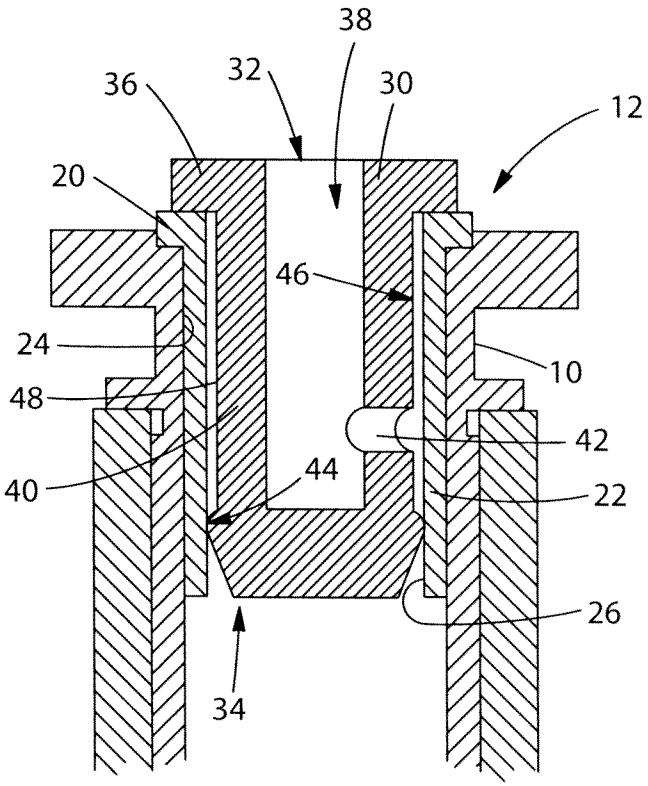
FIG. 2 is a partial cross-sectional view of the container and valve shown in FIG. 1.

One aspect of the invention provides for a valve, comprising: a sleeve comprising a sleeve wall including an inner surface; and a plug positioned within the sleeve, the plug comprising at least one portion that is elastically deformable, a blind hole extending into the plug from one end thereof to define a plug side wall, and a flow passage that extends through the plug side wall that is either open or openable, wherein the plug side wall has an outer section that is sealed against the inner surface of the sleeve wall when the plug is an unstressed state to define a valve closed position, and wherein the plug is capable of elastically deforming in the presence of a sufficient normal stress so that the sealed outer section of the plug side wall releases from the inner surface of the sleeve wall to define a flow channel between the plug and the sleeve that is in fluid communication with the plug flow passage and blind hole to define a valve open position.

Another aspect of the present invention provides for a valve, comprising: a plug comprising a plug first end, a plug second end, a blind hole created within the plug that extends from the plug first end to a blind hole bottom and that is spaced apart form the plug second end, a plug side wall extending radially outwardly from the blind hole to an outer surface of the plug, and a flow passage that extends through the plug side wall that is either open or openable; and a tube that is partially disposed within the blind hole, the tube comprising an internal channel, at least one open end that is in fluid communication with the internal channel, a tube sidewall extending radially outwardly from the internal channel to an outer surface of the tube, and a tube hole extending through the tube sidewall, wherein the plug has at least one section that is elastically deformable so that the outer diameter of the plug in the at least one section decreases when the plug is elastically deformed in the presence of a normal force that is applied to the plug via the tube.

Yet another aspect of the present invention provides for a valve, comprising; a bushing comprising a first end and an opposing second end; a tube slidably disposed within at least the first end of the bushing, the tube comprising an internal channel, an open end in fluid communication with the internal channel, a sidewall extending radially outwardly from the internal channel to an exterior surface of the tube, and a tube hole extending through the sidewall that is in fluid communication with the internal channel and open end; and an elastically deformable cap covering the bushing second end, the cap comprising an flow passage that is either open or openable, wherein the cap flow passage is out of alignment with the tube hole when the elastically deformable cap is in an unstressed state but is capable of aligning with the tube hole when the cap is stressed sufficiently to elastically deform the cap, and wherein the tube hole is optionally positioned in a portion of the tube that is disposed within the bushing when the elastically deformable cap is in an unstressed state.

Yet another aspect of the present invention provides for a dispenser, comprising one of the valves of the present invention. In one embodiment the dispenser comprises a container comprising a container opening and a container body; an annular sealing member that is defined by an inner wall of the container opening, by a separate annular body disposed within the container opening, or a combination thereof; a plug positioned within the annular sealing member, the plug comprising at least one portion that is elastically deformable, a blind hole extending into the plug from one end thereof to define a plug side wall, and a flow passage that extends through the plug side wall that is either open or openable; and a tube partially disposed within the plug blind hole, the tube comprising an internal channel, at least one open end that is in fluid communication with the internal channel, a tube sidewall extending radially outwardly from the internal channel to an outer surface of the tube, and a tube hole extending through the tube sidewall, wherein the plug is capable of elastically deforming with displacement of the tube to convert the valve form a normally closed position to an open position.

DETAILED DESCRIPTION OF THE INVENTION

The present invention may be understood more readily by reference to the following detailed description of illustrative and preferred embodiments. It is to be understood that the scope of the claims is not limited to the specific components, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

The present invention is directed to valves useful for the control of material flow therethrough. The valves can be used in a variety of applications, including, for example, in containers for dispensing consumer products. Preferred valve embodiments generally employ an elastically deformable member that seals against complementary components to form a valve closed or reduced flow position. Stress can be applied to the elastically deformable member whereby dimensional changes occur to release sealed areas to define flow paths through the valve, thereby converting the valve from a normally closed position to an open position.

Figure 1:
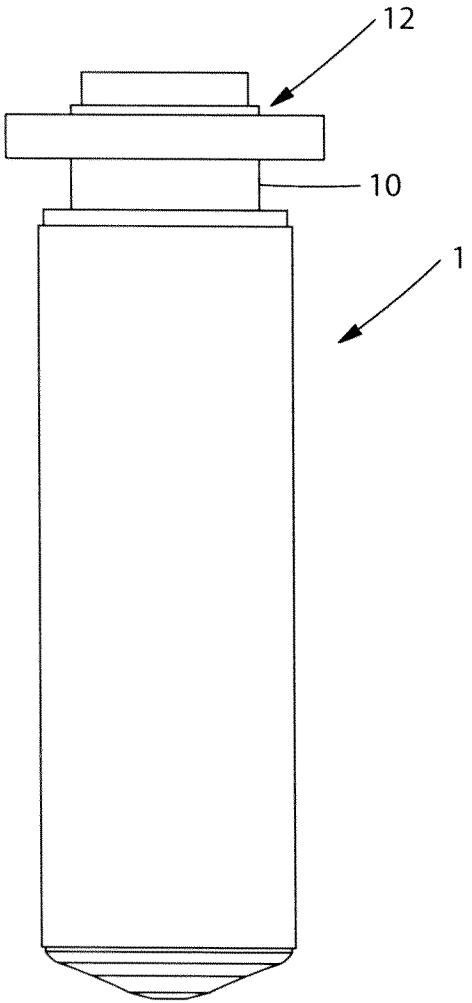
FIG. 1 is a side view of a container including an exemplary valve embodiment of the present invention.

With reference now to the figures, and in particular FIG. 1, a material dispensing system 1 is shown, which includes a container preform 10 and a valve 12, created by compression molding technology, disposed within a top opening of preform 10. Although not critical to or limiting on the claimed valves, container preform 10 can be created with injection molding technology, and then subsequently blow molded or otherwise formed into a final collapsible container (not shown). As shown in FIG. 1, container preform 10 is surrounded by an elastic band which is expandable with the container so as to provide the driving force for dispensing material charged into the final container.

Figure 4:
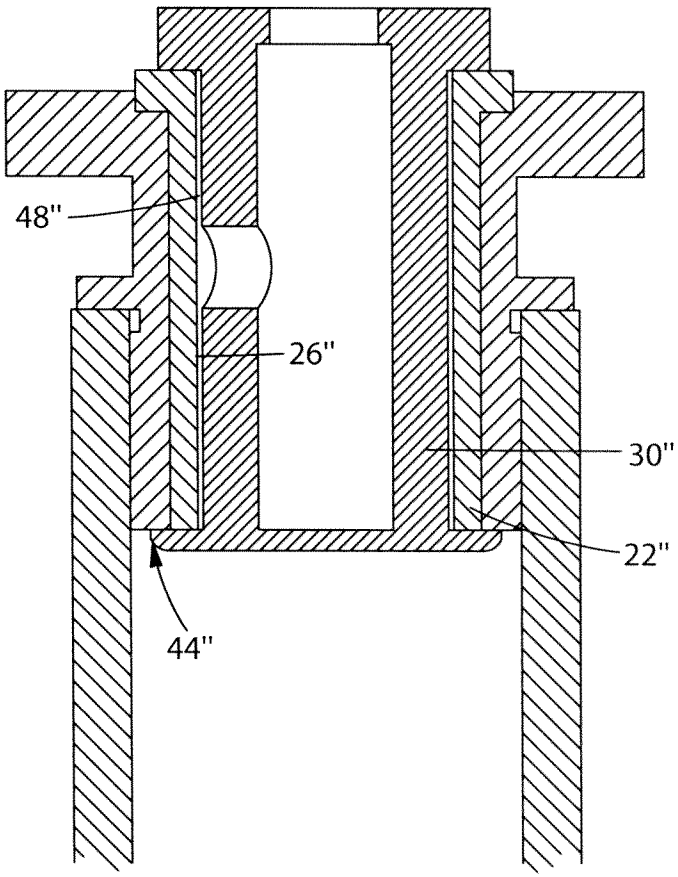
FIG. 4 is a cross-sectional view of a third exemplary valve embodiment.
Figure 3:
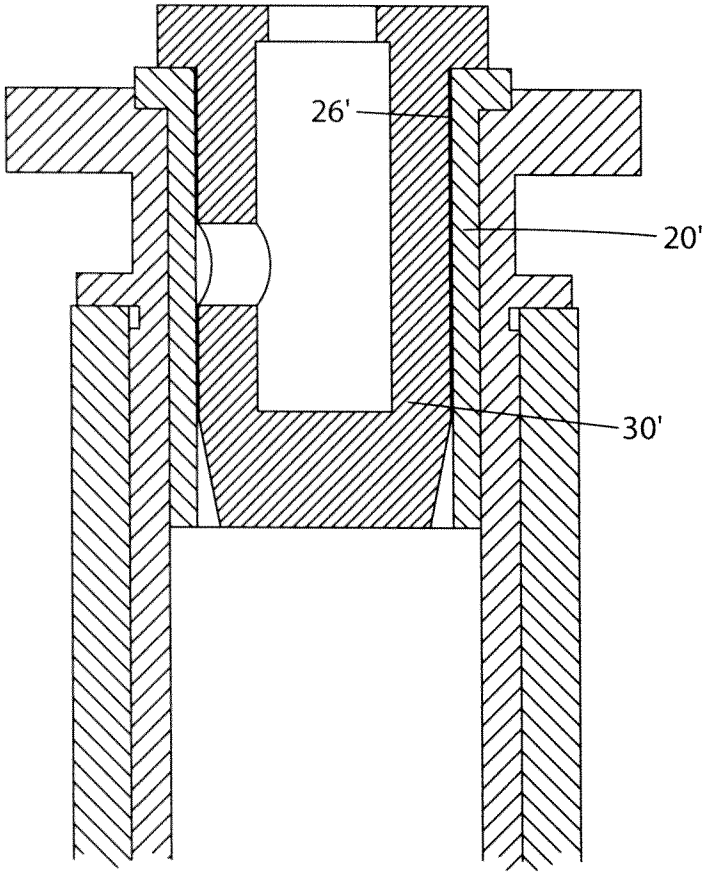
FIG. 3 is a cross-sectional view of a second exemplary valve embodiment.

A cross-sectional view of exemplary valve 12 is shown in FIG. 2, and includes a sleeve 20 and a plug 30 positioned within sleeve 20. Sleeve 20 comprises a sleeve wall 22, and outer surface 24 that abuts the opening formed in container preform 10, and an inner surface 26 that cooperates with plug 30 to form a seal in the valve's normally closed position. Plug 30 has a first open end 32 and an opposing closed end 34. An optional flange 36 is defined proximate first end 32. A blind hole 38 extends into plug 30 from first end 32 to define a plug side wall 40. A flow passage 42 extends through plug side wall 40. Flow passage 42 is illustrated as an open through hole. The flow passage could also be a slit or other structure that extends through plug side wall 40, which appears to be closed, but can become opened when plug 30 is elastically deformed. The skilled artisan would appreciate that more than one flow passage can be employed. Plug 30 contains an outer section 44 of increased diameter that seals against the inner surface 26 of sleeve 20 when valve 12 is in a closed position. The remaining outer section 46 of plug 30 that faces sleeve inner surface 26 is spaced apart from the inner surface. The gap 48 that is defined from this configuration can help with sticking issues when attempting to convert the valve from a closed position to an open position. In an alternative embodiment that is shown in FIG. 3, a gap does not exist, whereby the entire (or nearly entire) exterior portion of the plug 30' that faces the inner surface of the sleeve 20' is sealed against the inner surface 26'. In yet another embodiment that is shown in FIG. 4, a gap 48" exists along the entire length of the plug 30" that faces the sleeve inner surface 26", and an increased diameter section 44" exists at a distal section of the plug 30" so as to seal against the lower rim of the sleeve wall 22".

Figure 5:
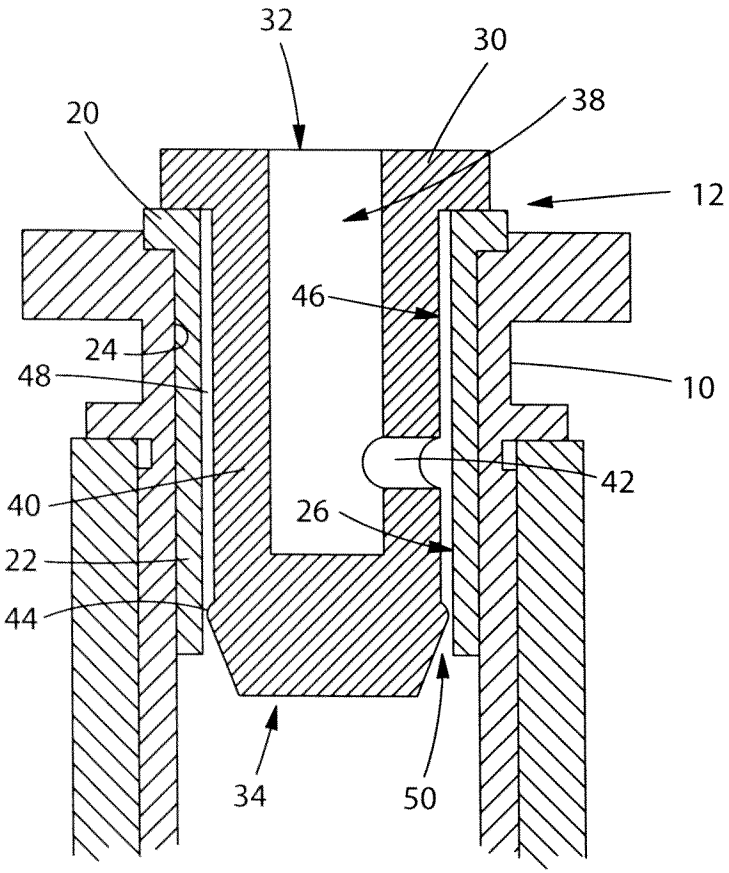
FIG. 5 is a cross-sectional view of the valve shown in FIG. 2 in an open position.

Plug 30 is shown in FIG. 2 in an unstressed state, and thus, valve 12 is illustrated in its normally closed position. Plug 30 is elastically deformable, and with a sufficient amount of stress, can elongate (stretch) lengthwise. This elongation or stretching increases the plug's length while decreasing its effective diameter. And the reduction in the plug's effective diameter causes outer section 44 to release from the inner surface 26 sufficiently to create a flow channel 50 between plug 30 and sleeve 20 that is in fluid communication with flow passage 42 and blind hole 38. Referring now to FIG. 5, valve 12 accordingly is accordingly converted from a closed position to an open position as flow channel 50 is created. The skilled artisan would readily appreciate that alternative plug embodiments may elastically deform in ways other than or in addition to that described above to establish an open valve position.

Valves of the present invention may be used during the filling operations of containers, wherein flowable or dispensable compositions can be charged into a container employing the valves and the compositions maintained by the closed valve until dispensing is desired. In this application, with reference to exemplary valve 12 for example, the pressurized composition is introduced into blind hole 38 to create the necessary stress level to elongate plug 30 to the extent that outer section 44 releases from sleeve inner surface 26 to create the flow channel between the plug and sleeve. The pressurized composition is then permitted to enter into the container's available fillable volume by flowing through the valve.

Figure 10A:
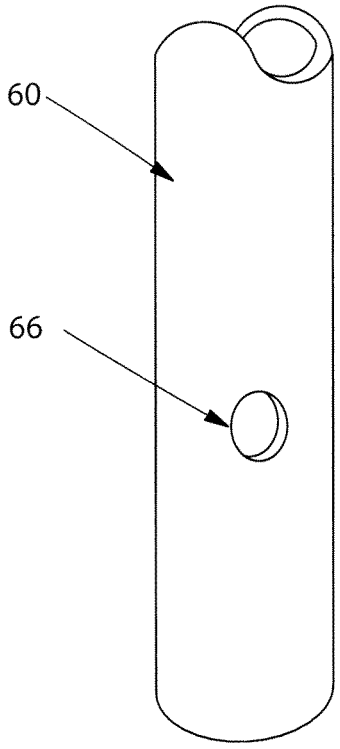
FIGS. 10A and 10B are side views of two tubes, each in accordance with at least one embodiment of the present invention.
Figure 10B:
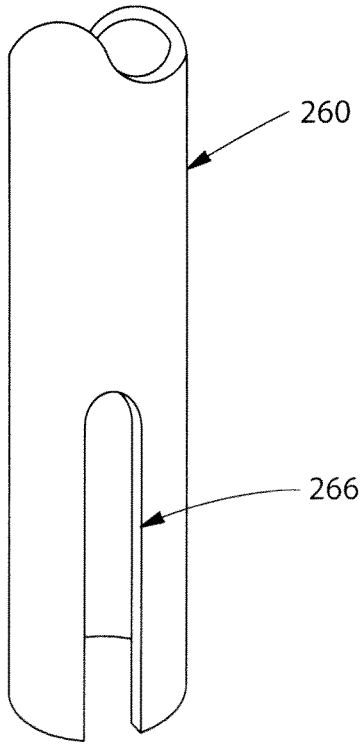

Other origins of stress can be used to convert the valve from a closed position to an open position. For example, and with reference to FIG. 6, exemplary valve 12 is shown with a tube 60 that is partially disposed within blind hole 38. Tube 60 can form all or part of a conduit associated with an actuator/nozzle component for dispensing compositions from a container employing valves of the present invention. Tube 60 comprises an internal channel 62 which defines a tube side wall 64. A through hole 66 extends through tube side wall 64 so as to be able to communicate flowable materials between flow passage 42 that is defined in the plug side wall 40 and internal channel 62. The through hole 66 can be larger in diameter or size verses the flow passage 42 that is defined in the plug so that it can reduce alignment issue when the valve is stressed during dispensing. Also the through hole 66 can be an open ended slot extending from downwards towards the bottom of the tube 26. FIGS. 10A and 10B provides two examples of a tube 60 (FIG. 10A) which has a through hole 66 and tube 260 (FIG. 10B) which has a through hole 266 which is in the form of a open ended slot on the right. Downward displacement of tube 60 provides the needed stress to elongate plug 30 sufficiently to release outer section 44 from the sleeve inners surface 26 to open the valve. The tube can be made from a variety of materials, including, for example, metal, glass, and plastic. The tube can be sized to provide a relatively tight fit within the plug blind hole. And the tube and/or plug blind hole may employ various features, such as at least one annular ring, alternatively more than one such as two or three, to effectuate a seal between the tube and the blind hole to minimize leakage around the tube and out of the plug blind hole.

Figure 6:
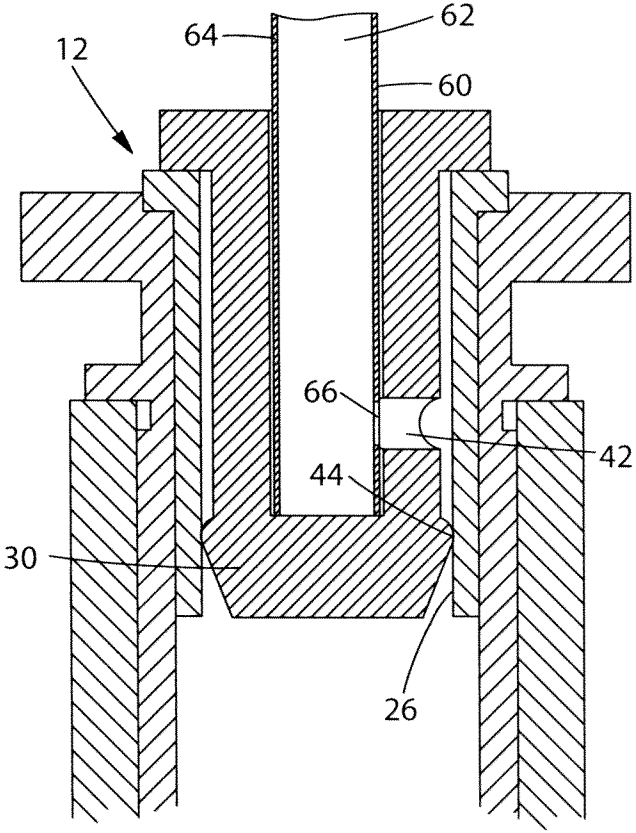
FIG. 6 is a cross-sectional view of the valve shown in FIG. 2 and including a tube, such as that associated with an actuator, inserted into the valve.

With continued reference to FIG. 6, tube through hole 66 is shown as being both in axial alignment and circumferential alignment with plug flow passage 42 when the plug is in an unstressed state. The tube through hole may however be out of alignment with the plug flow passage. The tube may be sufficiently rotatable within the plug blind hole to enable the tube through hole to be circumferentially out of alignment (partially or completely) with the plug flow passage to provide a "locking mechanism" to minimize or eliminate material dispensing when the tube is displaced inadvertently. Similarly, the tube through hole may be axially out of alignment (partially or completely) with the plug flow passage when the plug is unstressed; and alignment occurs when the plug is stressed and elongated/stretched.

As shown in FIG. 2, optional sleeve 20 serves as an annular sealing member for plug 30. In an alternative embodiment which does not include sleeve 20, the sealing function of sleeve 20 can be performed by ensuring sufficient contact between a portion of the valve (such as the one or more annular rings 44) and the inner wall of the container perform 10. It will be understood by one of ordinary skill in the art that optional sleeve 20 can be made of the same or a different material having a different glass transition temperature to minimize the possibility that the dimensions, inner diameter, inner surface integrity (smoothness and cylindrical shape) of the inner sleeve change upon heating and cooling. It is believed that providing the optional sleeve 20 decreases the occurrence of deformation resulting from heating process prior to blow molding. This helps ensure a good fit with the plug and or annular rings. That is, the container opening and/or container neck defines the sleeve component of the valve. It should be noted that a separate sleeve can be used even if plug 30 is placed within a container opening and/or container neck, whereby a single plug could be used in different sized container openings by varying the outer diameter of the sleeve.

The sleeve component is preferably made from a material that is rigid enough to provide a sealing surface for the associated plug component. Suitable materials may include, for example, plastics such as polyolefins, polyesters, polycarbonates; metal, wood, glass, and cardboard (can be coated with a hydrophobic material such as a wax). In one exemplary embodiment, the sleeve comprises a thermoplastic material and is made by injection molding. Other materials and manufacturing techniques may be used. The plug component is shown as a unitary body in the figures. In this configuration, the entire plug is elastically deformable such as, for example, being made from an elastomeric material (e.g., natural or synthetic rubber). In other embodiments (not shown), the plug can be made from two or more distinct parts and/or materials whereby only a portion of the plug is meant to be elastically deformable. By way of example only, the respective ends of the plug could be made from a thermoplastic and the middle section be made from an elastomeric material. In such a configuration, the separate sections can be made in distinct operations and then assembled, or can be made by multi-component molding techniques (e.g., dual injection molding with a thermoplastic material and a thermoplastic elastomer material (TPE)). Multi-component molding techniques may also be used for molding the plug and sleeve both in a single mold assembly (including molds with rotatable sections).

It should be appreciated that the plug and sleeve components can have a variety of different geometries and features as compared to those shown in FIGS. 1-6. By way of example only, the plug and/or sleeve can be a right circular cylinder, or in alternative embodiments can be oval, square-shaped, or other. Also, the components are shown as having fairly uniform walls; in other embodiments, the component walls can vary in dimension.

Figure 7:
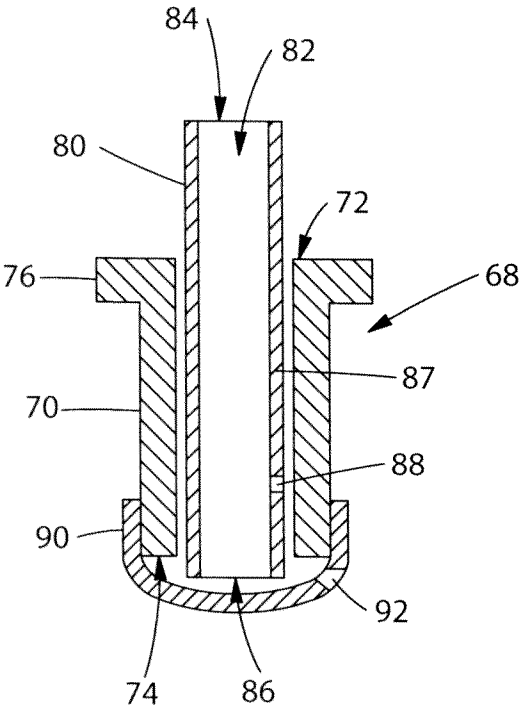
FIG. 7 is a cross-sectional view of a fourth exemplary valve embodiment.

Referring now to FIG. 7, an alternative valve embodiment is shown. Valve 68 includes a bushing 70, a tube 80 slidably disposed within the bushing, and an elastically deformable cap 90 covering an end of the bushing 70. Bushing 70 has a first end 72 and an opposing second end 74. An optional flange 76 is disposed about first end 72 to aid in securing valve 68 to a container or other flow device. The bushing may employ other features and/or the valve may employ other components that aid in securing the valve to host devices. Tube 80 includes an internal channel 82, an open end 84, an opposing end 86 (which may be open or closed), a sidewall 87, and a tube hole 88 extending through the sidewall that is in fluid communication with internal channel 82 and open end 84. Elastically deformable cap 90 has a flow passage 92 extending through its wall 94. Flow passage 92 is shown as an open hole in FIG. 7, but could also be a slit or other structure that extends through cap wall 94, which appears to be closed, but can become opened when cap 90 is elastically deformed. Cap 90 is shown as extending up along the exterior of bushing 70, but it can alternately be affixed just to bushing second end 74. The cap may also be indirectly affixed to the bushing by way of one or more components. The cap may be made from any material that is elastically deformable, such as, for example, natural rubber, synthetic rubber, PVC, PU or a thermoplastic elastomer. The bushing and cap may be manufactured together, for example, with a co-molding technique, wherein the bushing is molded out of a thermoplastic and the cap is molded out of a thermoplastic elastomer.

Figure 8:
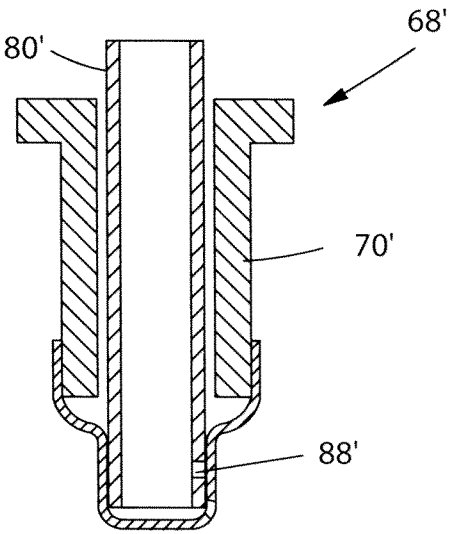
FIG. 8 is a cross-sectional view of a fifth exemplary valve embodiment.

As shown in FIG. 7, the tube hole 88 is located in a section of tube 80 that resides within bushing 70 in the valve's normally closed position. In an alternative valve embodiment 68' that is shown in FIG. 8, tube hole 88' is located in a distal section of tube 80' that is outside of bushing 70' in the valve's normally closed position. Similar to the embodiment shown in FIG. 6, the tube can form all or part of a conduit associated with an actuator/nozzle component for dispensing compositions from a container employing valves of the present invention. Displacement of the tube in the direction of the elastically deformable cap will elongate/stretch the cap sufficient to permit the tube hole to align with the cap flow passage to convert the valve from a closed position to an open position.

Figure 9:
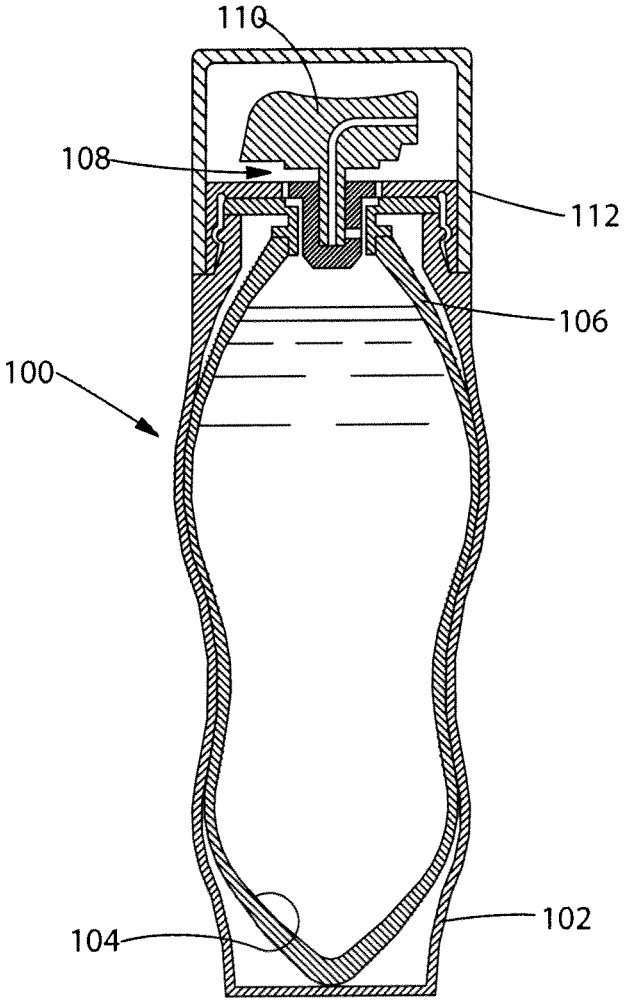
FIG. 9 is a cross-sectional view of an exemplary dispenser provided by the present invention.

Valves of the present invention can be used in numerous host devices for a variety of applications. One such host device is a dispenser for dispensing flowable compositions. By way of example only and with reference to FIG. 9, a dispenser 100 is shown, including an outer container 102, an inner flexible container 104 that is surrounded by an energy band 106, an exemplary valve 108, an actuator 110, and a closure 112. Although exemplary dispenser 100 utilizes potential energy associated with energy band 106 rather than propellants, valves of the present invention can be used in pressurized dispensers. The pressurized and non-pressurized dispensers employing valves of the present invention can be used to dispense a variety of compositions, including, for example, personal care products (e.g., cosmetics, antiperspirants/deodorants, skin care products, shave care products, fragrances, and hair care products), home care products, air care products, and pet care products.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A valve, comprising:

(a) a plug comprising a plug first end, a plug second end, a blind hole created within the plug that extends from the plug first end to a blind hole bottom and that is spaced apart from the plug second end, a plug side wall extending radially outwardly from the blind hole to an outer surface of the plug and a flow passage that extends through the plug side wall that is either open or openable; and (b) a tube that is partially disposed within the blind hole, the tube comprising an internal channel, at least one open end that is in fluid communication with the internal channel, a tube sidewall extending radially outwardly from the internal channel to an outer surface of the tube, and a tube hole extending through the tube sidewall, wherein the plug has at least one section having an outer diameter that is elastically deformable and elongatable lengthwise so that the outer diameter of the plug in the at least one section decreases when the plug is elastically deformed in the presence of a normal force that is applied to the plug via the tube.

2. The valve of claim 1, wherein the at least one section of the plug that is elastically deformable is made from a material comprising a rubber.

3. The valve of claim 1, wherein the tube is rotatable within the blind hole so that the tube hole can be in or out of circumferential alignment with the plug flow passage.

4. The valve of claim 1, wherein the tube hole is not in axial alignment with the plug flow passage when the plug is in an unstressed state.

5. The valve of claim 1, wherein the plug comprises at least a section of increased diameter along a length of the plug for fitting within a container opening and/or container neck.

6. A valve, comprising:

(a) a bushing comprising a first end and an opposing second end;

(b) a tube slidably disposed within at least the first end of the bushing, the tube comprising an internal channel, an open end in fluid communication with the internal channel, a sidewall extending radially outwardly from the internal channel to an exterior surface of the tube, and a tube hole extending through the sidewall that is in fluid communication with the internal channel and open end; and (c) an elastically deformable cap covering the bushing second end, the cap comprising an flow passage that is either open or openable, wherein the cap flow passage is out of alignment with the tube hole when the elastically deformable cap is in an unstressed state but is capable of aligning with the tube hole when the cap is stressed sufficiently to elastically deform the cap, and wherein the tube hole is optionally positioned in a portion of the tube that is disposed within the bushing when the elastically deformable cap is in an unstressed state.

7. The valve of claim 6, wherein a distal section of the tube extends beyond the second end of the bushing, wherein the tube hole is located in the distal section, and wherein the elastically deformable cap seals the tube hole closed when the elastically deformable cap is in an unstressed state.

8. A dispenser, comprising:

(a) a container comprising a container opening and a container body;

(b) an annular sealing member that is defined by an inner wall of the container opening, by a separate annular body disposed within the container opening, or a combination thereof; and (c) a valve, the valve comprising:

i) a plug positioned within the annular sealing member, the plug comprising at least one portion that is elastically deformable and elongatable lengthwise having an outer diameter, a blind hole extending into the plug from one end thereof to define a plug side wall, and a flow passage that extends through the plug side wall that is either open or openable; and ii) a tube partially disposed within the plug blind hole, the tube comprising an internal channel, at least one open end that is in fluid communication with the internal channel, a tube sidewall extending radially outwardly from the internal channel to an outer surface of the tube, and a tube hole extending through the tube sidewall, wherein the plug elastically deforms and elongates lengthwise with displacement of the tube so that the outer diameter of the plug in the at least one section decreases when the plug is elastically deformed in the presence of a normal force that is applied to the plug via the tube to convert the valve from a normally closed position to an open position.

* * * * *